United States Patent [19]

Mackrill

[11] Patent Number: 4,527,719

[45] Date of Patent: Jul. 9, 1985

[54] METHOD FOR MANUFACTURING ROSETTES

[76] Inventor: Hubert W. Mackrill, Haigh Head, Hoylandswaine, Sheffield, England

[21] Appl. No.: 448,393

[22] Filed: Feb. 9, 1983

[51] Int. Cl.[3] ..... D04D 7/04; D04D 9/04

[52] U.S. Cl. ..... 223/44; 223/46; 428/4

[58] Field of Search ..... 223/44, 46; 28/147, 28/150; 428/4, 5, 26, 27, 32; 40/1, 19

[56] References Cited

U.S. PATENT DOCUMENTS

| | | | |
|---|---|---|---|
| 3,021,038 | 2/1962 | Dean | 223/46 |
| 3,044,200 | 7/1962 | Teufel | 428/27 |

FOREIGN PATENT DOCUMENTS

| | | | |
|---|---|---|---|
| 1318965 | 1/1963 | France | 428/27 |
| 507349 | 6/1939 | United Kingdom | 428/5 |
| 944467 | 12/1963 | United Kingdom | 428/5 |
| 991809 | 5/1965 | United Kingdom | 223/46 |

*Primary Examiner*—Robert R. Mackey

*Attorney, Agent, or Firm*—Andrus, Sceales, Starke & Sawall

[57] ABSTRACT

A rosette includes a number of pre-pleated lengths of ribbon secured as radiating rings on a body part or carrier, the body part or carrier having a plurality of resilient clips which can be used for the securement of the ribbons. The rosette will preferably include a distinctive center and ribbon tails secured in position by a snap fitted rim element. Preferably, the body part or carrier is of thin-walled form, the resilient clips being pressed outwards from the plane of the thin wall.

6 Claims, 8 Drawing Figures

METHOD FOR MANUFACTURING ROSETTES

BACKGROUND OF THE INVENTION

The invention relates to the manufacture of rosettes of the kind widely used at agricultural shows, dog shows, horse shows and the like, that is to say being awarded in competition as an indication of merit, and also as used to indicate for example, allegiance to a particular political party.

Rosettes of the kind referred to are made of several radiating rings or bands of pleated ribbon attached to a particular carrier, the innermost rings or bands each partly overlapping the next larger ring or band. The ribbon may be pre-pleated and attached to the carrier or pleated and attached to the carrier in one operation. The ribbon may be attached to the carrier for example by stitching, stapling or by the use of an adhesive, the rosette being completed by the attachment of a distinctive center, the latter conveniently being attached by means of an adhesive, and by the attachment of ribbons and a clip, tape, safety pin or the like by means of which the rosette may be secured in position when in use. Rosettes of this kind may be of flat form using a two dimensional circular or oval carrier or may be of three dimensional form using a three dimensional carrier. A three dimensional carrier may, for example, be of frusto-conical form. Rosettes made in the manner described have been known for many years and are of an attractive appearance.

SUMMARY OF THE INVENTION

The object of the invention is to provide a method of making a rosette of either two dimensional or three dimensional form by means of which the resulting rosette will be equally as attractive as hitherto but which is produced at a much reduced cost.

It is another object of the invention to provide a method of making a rosette by means of which a three dimensional rosette of an unusual shape can very easily be made, for example a rosette of three dimensional horse-shoe shape.

In this invention, a method of making a rosette includes the steps of making a body part or carrier with a plurality of resilient clips, pre-pleating lengths of ribbon and securing the ribbon as radiating rings or bands on the body part or carrier by means of said resilient clips. The method may include the initial step of moulding the body part or carrier, integrally with the resilient clips, in a synthetic plastic material and may also include the step of moulding a rim element and the attachment of a distinctive center and of ribbon tails by the snap fitting of said rim element to the body part or carrier. The opposite ends of the pre-pleated lengths of ribbon on being secured to the body part or carrier by means of the resilient clips, may be connected together by staples or by an adhesive.

The body part or carrier may be made of thin-walled form, the lengths of ribbon being secured on one side of the thin wall of said body part or carrier by being engaged beneath the resilient clips which have been pressed outwards from the plane of the thin wall; if preferred, the method may include the step of spreading an adhesive on the other side of the thin wall of the body part where portions of the ribbons are there exposed.

The body part or carrier may be made in a three dimensional form, that is to say of frusto-conical form, of a three dimensional oval shape, or a three dimensional horse-shoe shape, or of some other three dimensional shape.

The method of making the rosette may include the final step of attaching a clip, tape or safety pin to the body part or carrier.

In another aspect of the invention, there is provided a rosette including a body part or carrier with a plurality of resilient clips, and a plurality of rings or bands of pleated ribbon secured to the body part or carrier by said clips. The rosette may include a distinctive center attached to the body part or carrier by a rim element snap fitted in position, and the rim element may be slotted for the fitment of ribbon tails. The body part or carrier may be provided with a clip, tape or safety pin by means of which the rosette can be attached, for example, to a horse's harness or to the wearer's person, as the case may be. The rosette may be of a three dimensional form, that is to say a frusto-conical form, or a three dimensional oval shape, or of some other three dimensional shape, or may be of two dimensional form.

DESCRIPTION OF PREFERRED EMBODIMENTS

Figure 1:
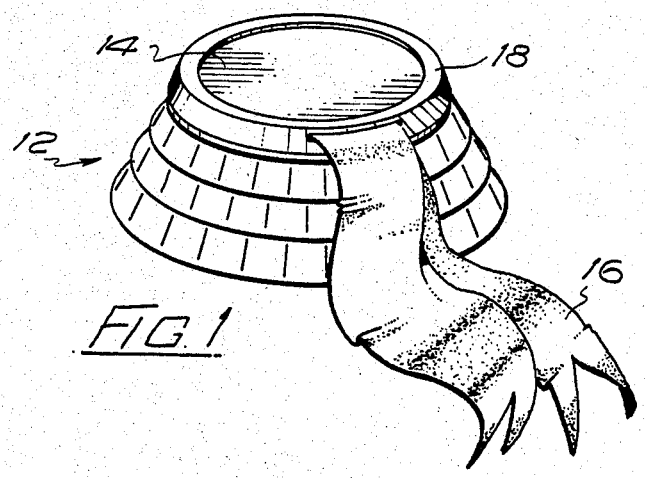
FIG. 1 is a perspective view of a rosette which has been made by a method embodying the invention.
Figure 2:
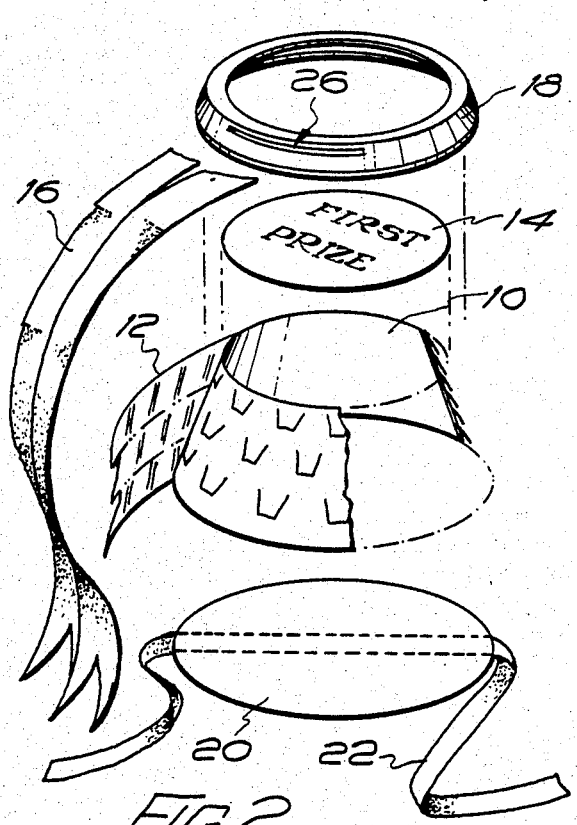
FIG. 2 is an exploded view.
Figure 3:
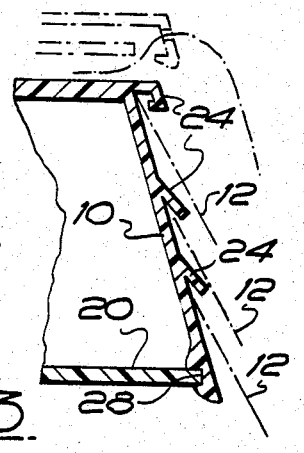
FIG. 3 is an enlarged view shown in section of a part of the rosette shown in exploded view in FIG. 2.

Referring now to FIGS. 1 to 3 of the drawings, the three-dimensional rosette there illustrated is constituted by six elements, that is to say a moulded three-dimensional plastic body part or carrier generally indicated 10 (in this case of frusto-conical form), a set of three pre-pleated ribbons 12, a center piece 14 of printed paper, a pair of ribbon tails 16, a rim element 18, and a backing piece 20 which can be clipped into position within the wider end of the frusto-conical body part or carrier. A length of tape 22 is secured to the backing piece by means of which the rosette can be attached, for example, to a horse's harness or to the wearer's person, as the case may be. (The manner in which the tape is secured to the backing piece is not shown but can take one of several forms. For example, it may be riveted thereto or trapped beneath a specially moulded clip configuration of the backing piece).

As shown in FIG. 3, the body part or carrier has been moulded integrally with a plurality of resilient clips 24, arranged in circumferential rows, and the pre-pleated ribbons 12 are secured on said body part or carrier by means of said clips. That is to say, a marginal edge of each pre-pleated ribbon is secured to the body part or carrier, the arrangement being such that when the rosette has been fully assembled the clips securing the radially inner pre-pleated ribbon in position are masked by the rim element 18 and the clips securing the other pre-pleated ribbons in position are masked by the respectively overlapping areas of pre-pleated ribbon radially within them. The pre-pleated lengths of ribbon can be secured very quickly and conveniently to the body part or carrier by means of the resilient clips. As each pre-pleated length of ribbon is secured in position, its opposite ends are connected together by staples (not shown) but of course they could equally well be connected together by means of a suitable adhesive if preferred. The radially innermost row of resilient clips serve the dual purpose of retaining the rim element in position on the body part or carrier, the rim element having an inturned lip which snaps over the resilient clips. It will be seen that the rim element also has a slot 26 through which the ribbon tails can be threaded to extend, as shown by the chain-dotted line in FIG. 3, beneath the center piece 14 before the rim element is snap fitted in position.

Also as shown in FIG. 3, the backing piece 20 is capable of being clipped into position within the wider end of the frusto-conical body part or carrier, that is to say into a groove 28 extending around its inside surface.

It will be understood that by reason of the very simple "clip in" attachment of the lengths of pre-pleated ribbon to the body part or carrier, and the subsequent snap on attachment of the rim element 18, a rosette embodying the invention can be produced very quickly and therefore at a relatively low manufacturing cost. However, various modifications may be made. For example, the rosette need not necessarily be provided with the length of tape 22. On the contrary, a spring clip or a safety pin could be secured to the backing piece 20 so that the rosette could be attached, for example, to a horse's harness or to the wearer's person, as the case may be.

Figure 4:
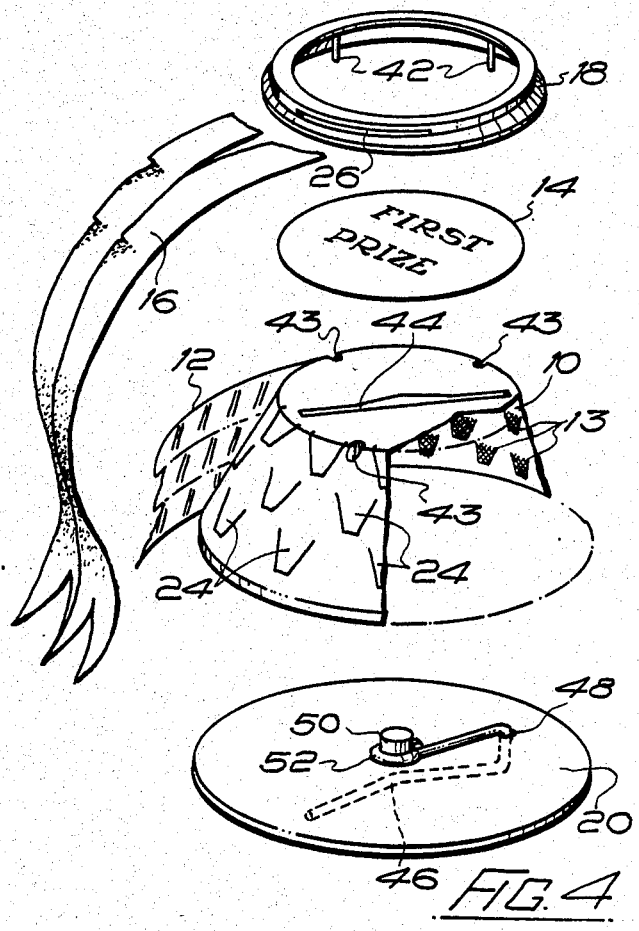
FIG. 4 is a view similar to FIG. 2 of a modified construction of rosette.
Figure 5:
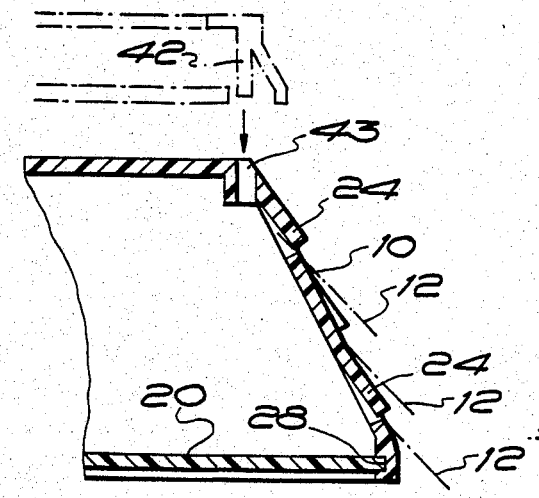
FIG. 5 is a view in section similar to FIG. 3 of a part of the rosette shown in FIG. 4.

In FIG. 4 of the drawings, there is illustrated a construction of rosette basically similar to that described above in that a set of three pre-pleated ribbons 12 are secured on the body part or carrier by a plurality of resilient clips 24 moulded integrally with said body part or carrier. However, in this case the body part or carrier has been made in the form of a thin-walled shell, the resilient clips 24 being defined by a pattern of slots in the shell. The arrangement is such that the resilient clips can be pressed outwards from within the body part or carrier as shown in FIG. 5 to facilitate the engagement of the pre-pleated ribbons beneath them. A further advantage of this form of body part or carrier is that, as shown in FIG. 4, when the pre-pleated ribbons have been secured thereon, the portions of said ribbons beneath the clips are exposed as indicated at 13 within the body part or carrier (the backing piece 20 not yet having been clipped in position). Consequently, if preferred, a suitable adhesive, for example a so-called hot melt adhesive, can be spread within the body part or carrier so that when set it retains the ribbons very securely beneath the resilient clips.

A further variation which will be observed in this modified construction of rosette is the fact that the rim element 18 is not provided with an inturned lip which snaps over the radially innermost row of resilient clips but is provided with a plurality of axially extending pins 42 which are a push fit in respective holes 43 which have been moulded in the body part or carrier around the outer edge of its narrower end face. In addition, the end face of the body part or carrier is provided with a narrow slot 44 through which the ends of the ribbon tails 16 can be passed before being masked by the center piece 14 and secured in position by the rim element 18 (through the slot 26 in which said ribbon tails also extend) being secured on the body part or carrier.

The backing piece 20 is again capable of being clipped in position within the wider end of the frusto-conical body part or carrier, that is to say into the groove 28 which extends around the inside surface of the latter, but in this case the backing piece is shown to be provided with a clip element 46 instead of with the length of tape of the first described embodiment. As shown, the backing piece has been specially designed for securing the clip element 46 in position. This has involved the forming of the backing piece with a hole 48 through which part of the clip element visible when in use has been caused to project and the moulding of a central spigot formation 50 on what is to be the inside surface of the backing piece. A ring-like root portion 52 of the clip element can be forced over said spigot formation 50 of the backing piece to secure the clip element in position.

Figure 6:
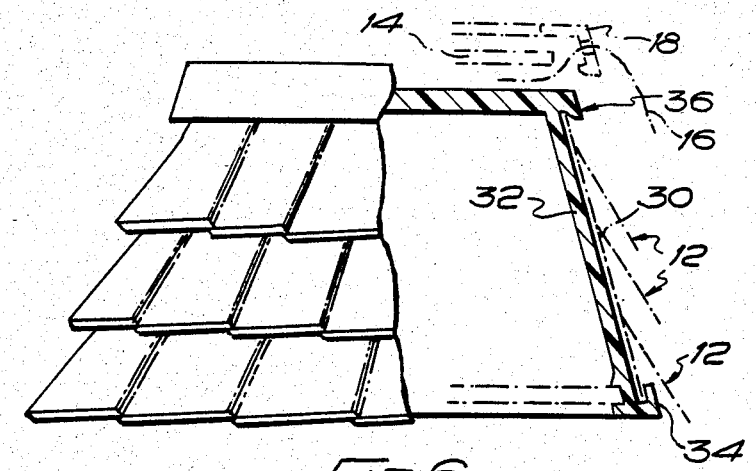
FIG. 6 is a part sectional view of a further modified construction of rosette which will presently be referred to, and FIGS. 7 and 8 are views which will be referred to when describing the method of manufacture of the rosette illustrated in FIG. 6.

Referring now to FIG. 6 of the drawings, in a further modified construction of rosette, the set of three pre-pleated ribbons 12 are secured on a carrier 30, the latter having the form of a frusto-conical sleeve secured on a generally plain frusto-conical body part 32. However, although the body part 32 is generally plain it is provided with an upturned lip 34 at its wider end, forming a shallow channel in which the sleeve-like carrier 30 is engaged, and at its narrower end it is provided with a stepped ridge 36 on which the rim element 18 can be snap fitted in position to make captive the sleeve-like carrier 30 and to secure the center piece 14 and ribbon tails 16 in position as in the first described embodiment.

Figure 7:
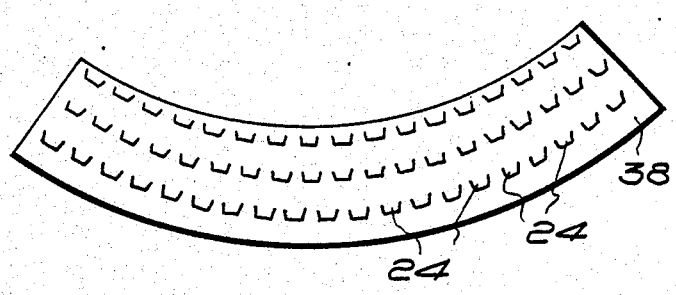
Figure 8:
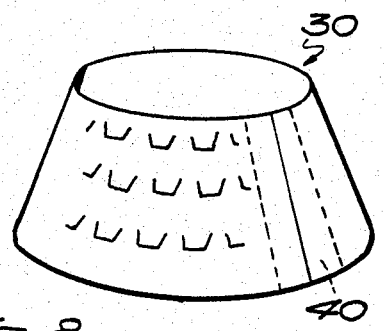

Referring now in particular to FIGS. 7 and 8, it will be seen that the carrier 30 has been formed from an arcuate length of card or thin plastic material 38, the opposite ends of which have been secured together by a strip 40 of self-adhesive material. The arcuate length of material has been provided with a plurality of resilient clips 24 by means of which the pre-pleated ribbons have been secured in position either before or after the arcuate length of material has been formed into the frusto-conical carrier. As in the case of the first described embodiment, when the rosette has been fully assembled the clips securing the radially inner pre-pleated ribbon in position are masked by the rim element 18 and the clips securing the other pre-pleated ribbons in position are masked by the respectively overlapping areas of pre-pleated ribbon radially within them.

Various modifications may be made to the method of manufacture just described. For example, instead of the opposite ends of the arcuate length of card or thin plastics material 38 being secured together by a strip of self-adhesive material they could for example be stapled together or be provided with interlocking formations.

Although the illustrated examples are of rosettes of frusto-conical form it will be understood that the invention may be used for the making of other three dimensional forms of rosette, for example by using a body part or carrier of a three dimensional oval form or of some other three dimensional shape such as a horse-shoe shape. Indeed, the invention may be applied to the making of a two dimensional rosette, that is to say a rosette of flat form, in which case the body part or carrier may be of flat disc or oval shape, or of some other two-dimensional shape, with resilient clips.

I claim:

1. A method of making a rosette, the method including the steps of moulding a 3-dimensional body part with a plurality of radially outwardly projecting resilient clips arranged in circumferential rows; pre-pleating lengths of ribbon; securing the lengths of ribbon as radiating bands on the body part by means of said resilient clips, the clips engaging radially inner edge portions of the respective bands of pre-pleated ribbon and the radially inner bands masking from view the resilient clips securing the band immediately outside the respective inner band; and snap fitting a rim element on a portion of said body part so that the resilient clips securing the radially innermost band of pre-pleated ribbon are masked from view by said rim element.

2. A method according to claim 1, in which the opposite ends of the pre-pleated lengths of ribbon, on being secured to the body part by means of the resilient clips, are connected together by fastening means.

3. A method according to claim 1, in which the body part is made of thin-walled form, and the lengths of ribbon are secured on one side of the thin wall of said body part by being engaged beneath the resilient clips which have been pressed outwards from the plane of the thin wall.

4. A method according to claim 3, including the step of spreading an adhesive on the other side of the thin wall of the body part where portions of the ribbons are there exposed.

5. A method according to claim 1, including the step of moulding the rim element in a synthetic plastic material.

6. A method according to claim 1, wherein said rim element includes a distinctive center and ribbon tails extending through a slot in said rim element to position end portions of the ribbon tails beneath the center, said method further including the step of attaching the distinctive center and ribbon tails to the body part by the snap fitting of said rim element to the body part.

* * * * *